US008562351B2

(12) United States Patent
Preston et al.

(10) Patent No.: US 8,562,351 B2
(45) Date of Patent: Oct. 22, 2013

(54) SYSTEM AND METHOD TO DETECT TARGET HITS

(75) Inventors: Steven Preston, Winter Springs, FL (US); Edward S. Kaprocki, Debary, FL (US); Tom Penner, Apopka, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 315 days.

(21) Appl. No.: 12/906,597

(22) Filed: Oct. 18, 2010

(65) Prior Publication Data

US 2012/0094256 A1 Apr. 19, 2012

(51) Int. Cl.
*F41G 3/26* (2006.01)

(52) U.S. Cl.
USPC ..... 434/22; 434/11

(58) Field of Classification Search
USPC ..... 434/11–27; 348/135
See application file for complete search history.

(56) References Cited

U.S. PATENT DOCUMENTS 3,898,747 A * 8/1975 Marshall ..... 434/22
2009/0113731 A1 * 5/2009 Kallabis et al. ..... 33/227

* cited by examiner

*Primary Examiner* — Timothy A Musselman
(74) *Attorney, Agent, or Firm* — Schwegman Lundberg & Woessner, P.A.

(57) ABSTRACT

A device includes a first light source to be aligned along a path of a projectile. The first light source has a narrow divergence to simulate the path of the projectile. A second light source has a vertically wide divergence extending above the path of the projectile. The first and second light sources are encoded and aligned to facilitate distinguishing between head and body shots using only head sensors.

16 Claims, 6 Drawing Sheets

SYSTEM AND METHOD TO DETECT TARGET HITS

BACKGROUND

Placement of individual detectors on a player to sense laser simulated bullets is a problem for close combat training. The laser beam used to simulate firing is so small as it leaves the transmitter, that even having detectors spaced ten inches apart can cause a player to miss his target if aimed between the two detectors. To help this issue, the laser beam may be made as wide as practical. If the beam is too divergent, the laser beam intensity diminishes quickly with distance and will not reach out to the effective range of the host weapon that it is trying to simulate. Further, a wide beam can cause multiple hits to be detected whenever separate targets are close together, and may even cause false hits to be detected, reducing the effectiveness of training.

Some prior devices use multiple lasers, one with a low divergent beam and a second one with a wide beam. Laser transmitter design modifications are made to provide the different width beams, but such devices allow better close in firing operation and fewer detectors may be used on the target. Even with multiple lasers, care is taken with placement of detectors so that a shot between detectors will be detected. Such devices still utilize a large set of detectors spaced close together. These detectors are positioned near the center of mass so that a laser beam, firing at that point can hit its mark. The number of detectors and the separation between each of them in a cluster is dependant on the laser beam characteristics at the minimum range to be using in training.

SUMMARY

A device includes a first light source to be aligned along a path of a projectile. The first light source has a narrow divergence to simulate the path of the projectile. A second light source has a vertically wide divergence extending above the path of the projectile. The first and second light sources are encoded and aligned to facilitate distinguishing between head and body shots using only head sensors.

In further embodiments, the device has a headset that includes two horizontally spaced apart light sensors to be worn by a target. A further sensor may be placed on the rear of the headset.

A method includes projecting a first light source aligned along an expected path of a projectile, the first light source having a narrow divergence to simulate the expected path of the projectile. A second light source having a vertically wide divergence extends above the expected path of the projectile. The first and second light sources are encoded and aligned to facilitate distinguishing between head and body shots using only head sensors.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

The functions or algorithms described herein may be implemented in software or a combination of software and human implemented procedures in one embodiment. The software may consist of computer executable instructions stored on computer readable media such as memory or other type of storage devices. Further, such functions correspond to modules, which are software, hardware, firmware or any combination thereof. Multiple functions may be performed in one or more modules as desired, and the embodiments described are merely examples. The software may be executed on a digital signal processor, ASIC, microprocessor, or other type of processor operating on a computer system, such as a personal computer, server or other computer system.

Multiple laser beams with different divergence and a decoding system generate a target hit profile to simulate a typical target without the need to place detectors on or near the center of a center of mass of the target. In some embodiments, detectors are placed on a head of the target. The detectors in conjunction with the different divergence beams allow a differential determination between center of mass shot, left center of mass, right center of mass, and left side of head shot, right side of head, center of head, back of head, and back of body. This is done by a combination of segregating decoding elements, using multiple lasers, sending our variations in message timing between the lasers, and decoding these differences associated with specific detector hit by the beam without affecting the adjacent laser beam. All of the laser detectors can be located on the head area so that the target is not restricted in movement by a need to supplement detector areas all over the body and back.

Figure 1:
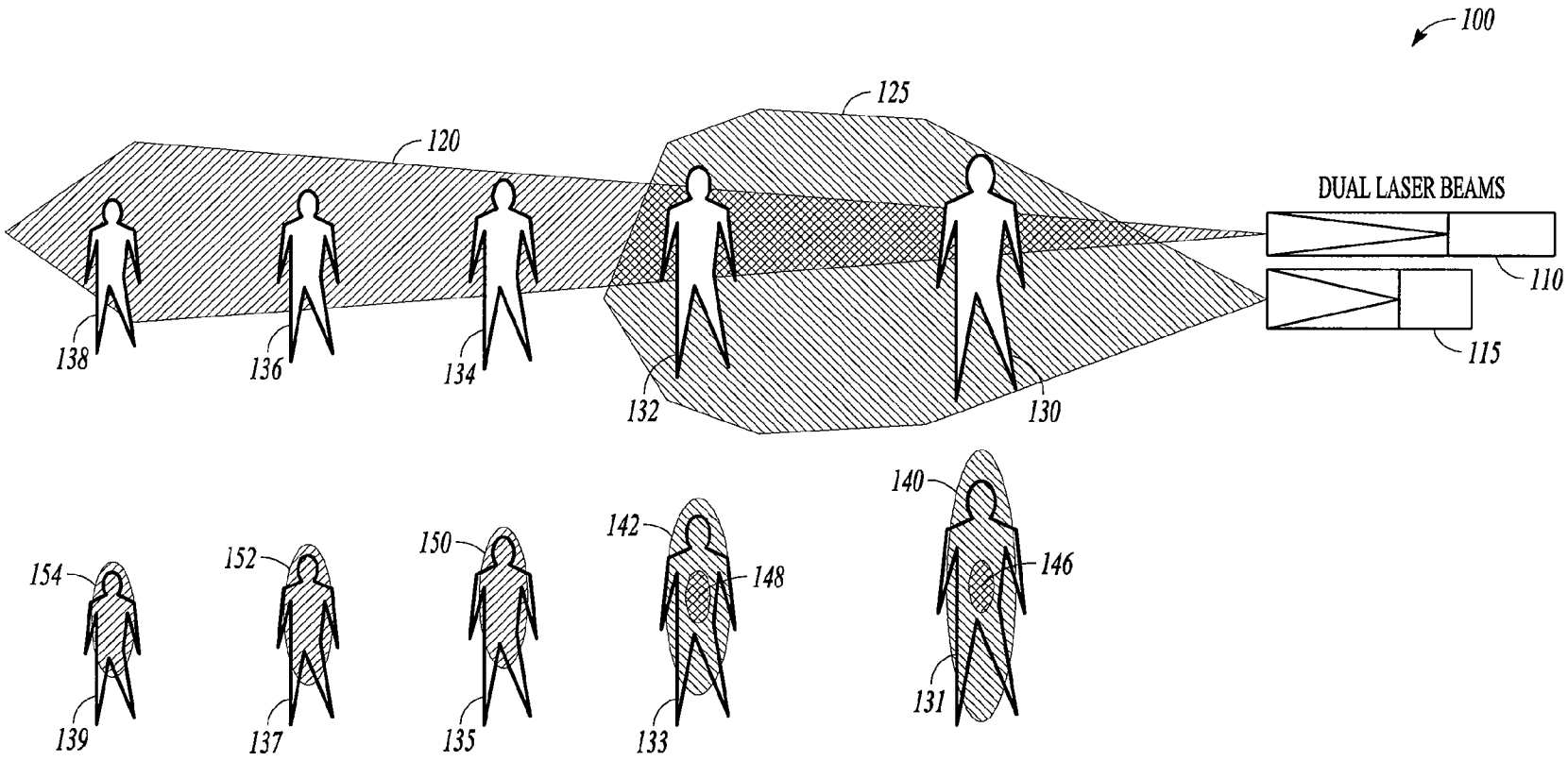
FIG. 1 is a block representation of a pair of light sources that provide divergent light beams according to an example embodiment.

FIG. 1 illustrates a pair of light sources 110 and 115 that provide divergent light beams 120 and 125. In one embodiment, the light sources are lasers that may be combined with optics to provide the beam divergence. In one embodiment, the light sources may be mounted on a gun, and be aligned with an aimpoint corresponding to an expected path of a projectile fired from the gun.

The beams 120 and 125 are shown in conjunction with targets 130, 132, 134, 136, and 138 at increasing distances from the light sources. As indicated, light source 110 is focused in a narrow beam 120 that has a small divergence. Light source 115 is focused in a tall divergence beam 125 that extends wider than beam 120, but likely has a shorter effective range for being detected. Cross sections of the beams are shown on front views of the targets indicated at 131, 133, 135, 137, and 139. Beam 125 has a cross section indicated at 140 on target 130, 131, and cross section 142 on target 133. Beam 120 has an increasing cross section as the distance from the light sources increases with each target as indicated at 146, 148, 150, 152, and 154. Targets at increasing distance from the light sources do not detect the tall divergence beam 125.

While two separate lasers are shown for generating light, in a further embodiment, a single laser may be used with bi-angular lensing to form 2 widely different divergent paths from a single source. When two lasers are used, they may be critically aligned together on a gun, along the expected path of a projectile fired from the gun. Either method may be used. If biangular lensing is used, critical divergence may be held to insure eye safety. If dual lasers are used, the alignment method may be secure enough to allow operation in a harsh environment without moving either or both of the lasers off the target at any time.

Figure 2:
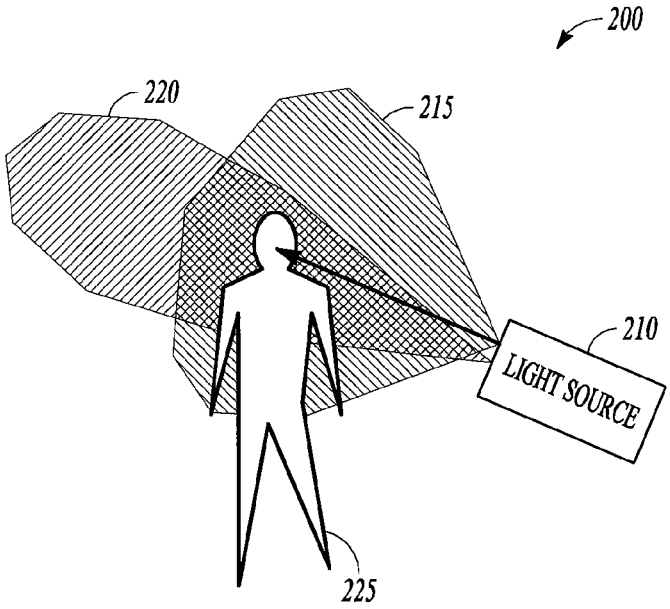
FIG. 2 is a block representation of light beams corresponding to a head shot according to an example embodiment.
Figure 3:
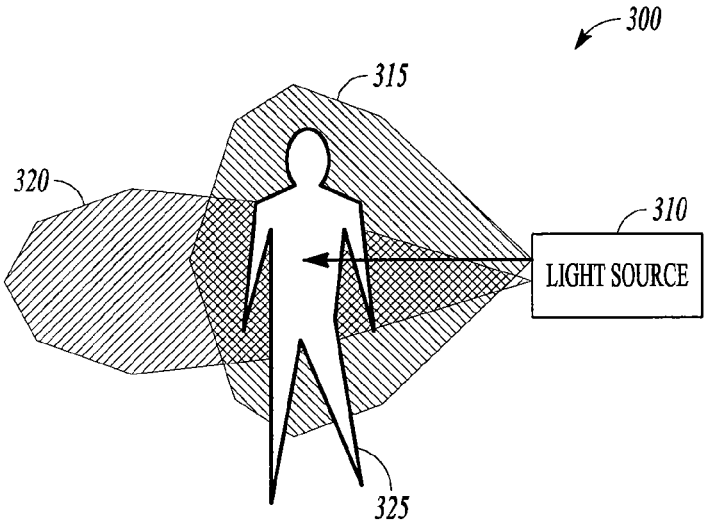
FIG. 3 is a block diagram of light beams corresponding to a body shot according to an example embodiment.

Representations of the beams in a head shot and a body shot are shown in FIGS. 2 and 3 respectively at 200 and 300. In FIG. 2, a light source 210 provides both a tall divergent beam 215 and narrow divergent beam 220. The light source is shown aimed at the head of a target 225. Both beams are seen as impinging on the head, and are therefore likely to be detected by one or more head sensors and be characterized as a head shot. In one embodiment, beam 215 is tall enough to allow a center of mass shot and have the beam reach the head area to be detected by head the detection sensors.

In FIG. 3, a light source 310 provides both a tall divergent beam 315 and narrow divergent beam 320. The light source is shown aimed at the body of a target 325. Beam 320 contacts the body, but not the head of target 325. Beam 315 contacts both the both and head of the target 325. This shot will be characterized as a center of mass shot, also referred to as a body shot.

In one embodiment, narrow divergent beam has a vertical divergence of between approximately 3-4 miliradians. The narrow divergent beam may have a horizontal divergence of approximately 2 miliradians or less. The tall divergent beam in one embodiment has a vertical divergence of approximately 6 miliradians. The horizontal divergence of both beams is less than the vertical divergence in some embodiments, to allow distinguishing between left and right side of target shots.

Figure 4A:
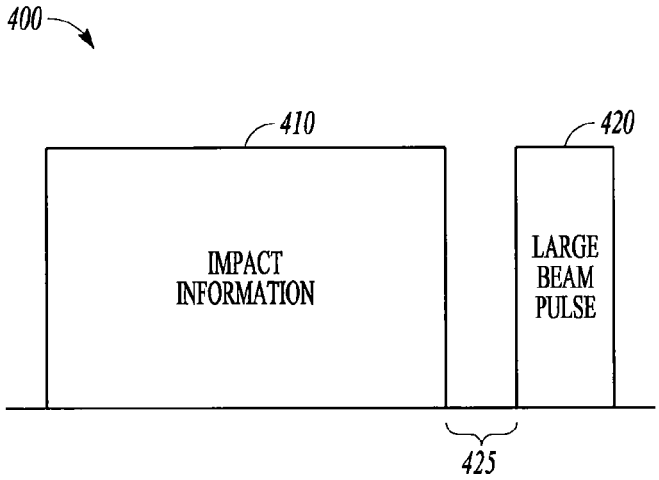
FIGS. 4A and 4B are a timing diagram illustrating signals received from the light beams for body and head shots according to an example embodiment.
Figure 4B:
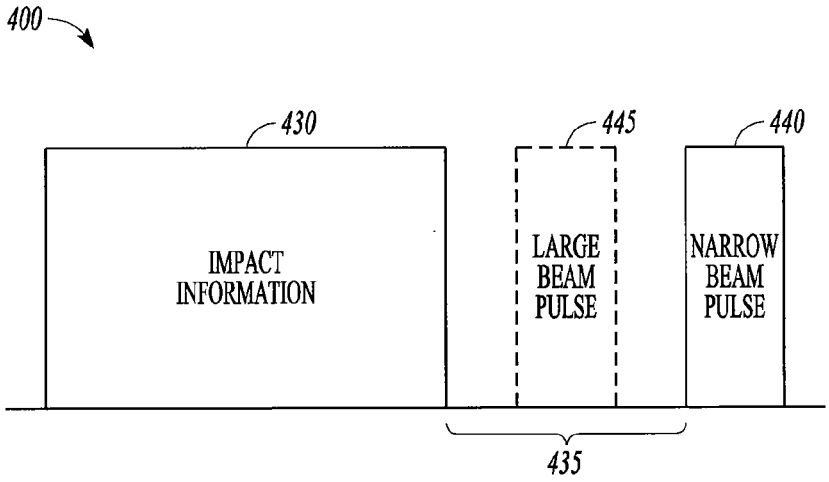

Encoding information in the beams is illustrated FIGS. 4A and 4B at 400. The encoding in one embodiment is in the form of the timing of laser pulses to allow differentiation of light detected at the target. Laser impact information 410 is first received, followed by a pulse 420 from the more divergent or taller beam. A body shot timing hold off is indicated at 425, representing the time period between the impact information 410 and pulse 420. This type of detection will be interpreted as a body shot.

Timing for a head shot is shown with impact information 430 being received. A head shot timing hold off period is shown at 435, after which a pulse 435 form the narrow beam is received. The hold off period 435 subsumes a large beam pulse 445 received between the impact information 430 and narrow beam pulse 440. This temporal sequence of received pulses will be interpreted as a head shot. Note that for longer distances to the target, detection of the larger beam may or may not occur.

Figure 5:
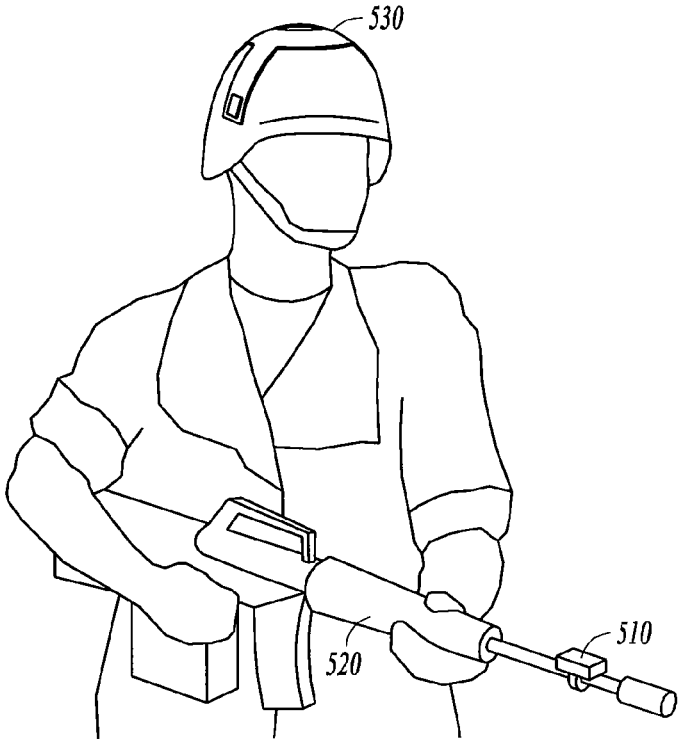
FIG. 5 illustrates the light sources clamped on to a weapon such that light from the light sources is aligned along an expected path of a projectile from the weapon according to an example embodiment.

FIG. 5 illustrates the light sources at 510 clamped on to a weapon 520 such that light from the light sources is aligned along an expected path of a projectile from the weapon 520. Various methods may be used to clamp the light sources onto the weapon 520 while maintaining their alignment, such as mechanical clamps, adhesive, tape, and other means of attaching. A person wearing a detector head module 530 is shown holding the weapon 520, which may be a real weapon without live ammunition for training purposes.

Figure 6:
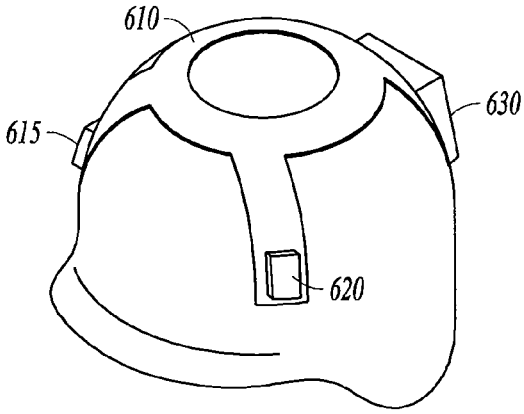
FIG. 6 is a perspective block representation of a head detection module according to an example embodiment.

Further detail of a head detection module or head set 610 is shown in FIG. 6. Two light or laser detectors or sensors 615 and 620 are shown spaced apart and mounted on the sides of the head set 610 to detect light impinging on the head set 610 from a front of a person wearing the head set 610. A further light detector 630 is shown mounted on a rear of the head set 610 to detect light impinging onto the backside of the person wearing the head set 610. Each of the detectors can detect and decode both the laser engagement message details as well as the information about which laser actually hit the headband area. The detectors may also be coupled to a processor or other electronics to process the information received by the detectors. The processors may be network enabled to allow communication of detections and other information to other information processing systems. In one embodiment, the head set 610 may be a helmet with chin straps. Such a helmet may be similar in weight and size to a helmet worn in actual combat.

Figure 7:
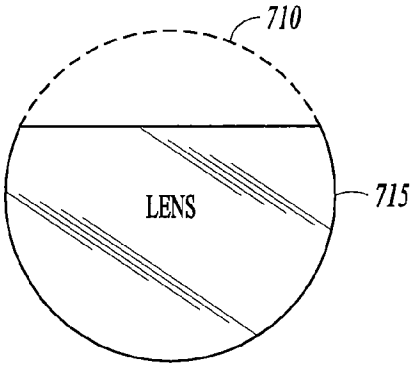
FIG. 7 illustrates a lens having a top portion removed according to an example embodiment.
Figure 8:
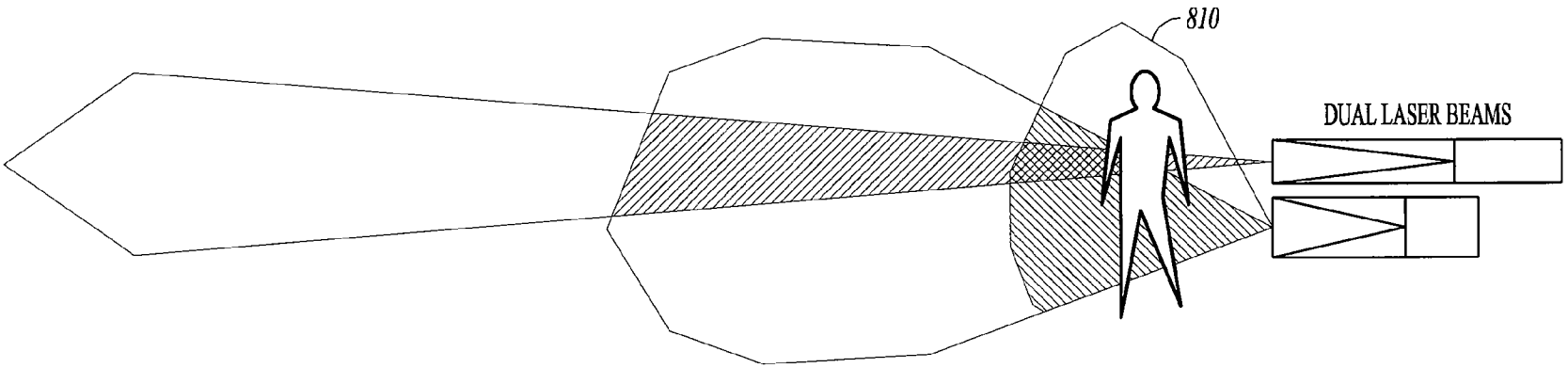
FIG. 8 is a block diagram illustrating light beams including scatter caused by the lens of FIG. 7 according to an example embodiment.

Because the divergence of the close in laser is so very wide, the focal distance to a lens system may be very short. This allows for an additional feature that enhances the system further. The characteristic divergence of a laser is not wide enough to completely fill a reasonably sized lens as the bare laser beam at the lens surface is typically smaller than the lens itself. This is especially true in the vertical direction along the axis of the raw laser itself. Therefore, in one embodiment, a top portion 710 of a lens 715 is removed such as by cutting it off as shown in FIG. 7. The remaining part of the lens results in an increase in the amount of scatter of laser energy at very close distances as shown at 810 in FIG. 8, so that at even closer ranges the beam will be directed more towards the head area than along the aimpoint of a weapon boresighted to the dual laser transmitter.

In a further embodiment, a hemispherical lens may be used as an optical element in the path of the laser beam to direct all light in a tall divergent beam along and above the aimpoint with a divergence of approximately 10 degrees in one embodiment. The lens works to bend the laser light impinging on the lens upwards, above the aimpoint.

In one embodiment, the laser beams are encoded with information, such as messages, which may be identical. The pulses 420 and 425 from both lasers, may include a "time distinct" secondary word or message identifier to identify which laser actually hit the detectors being decoded on the target. In this case the identifier may be a simple word or even an offset in a portion of the message stream that allows the target to determine which laser beam was actually detected.

Because body placed detectors are cause for limitation of movement and covering of body areas that would typically be used for carrying critical items, a detection system on the head is becoming very important to a training soldier. When the dual laser messaging is employed, the detection system used cannot only all detect body shots on the head, but also can determine if the aimpoint was towards the head or towards the body as shown below.

Figure 9:
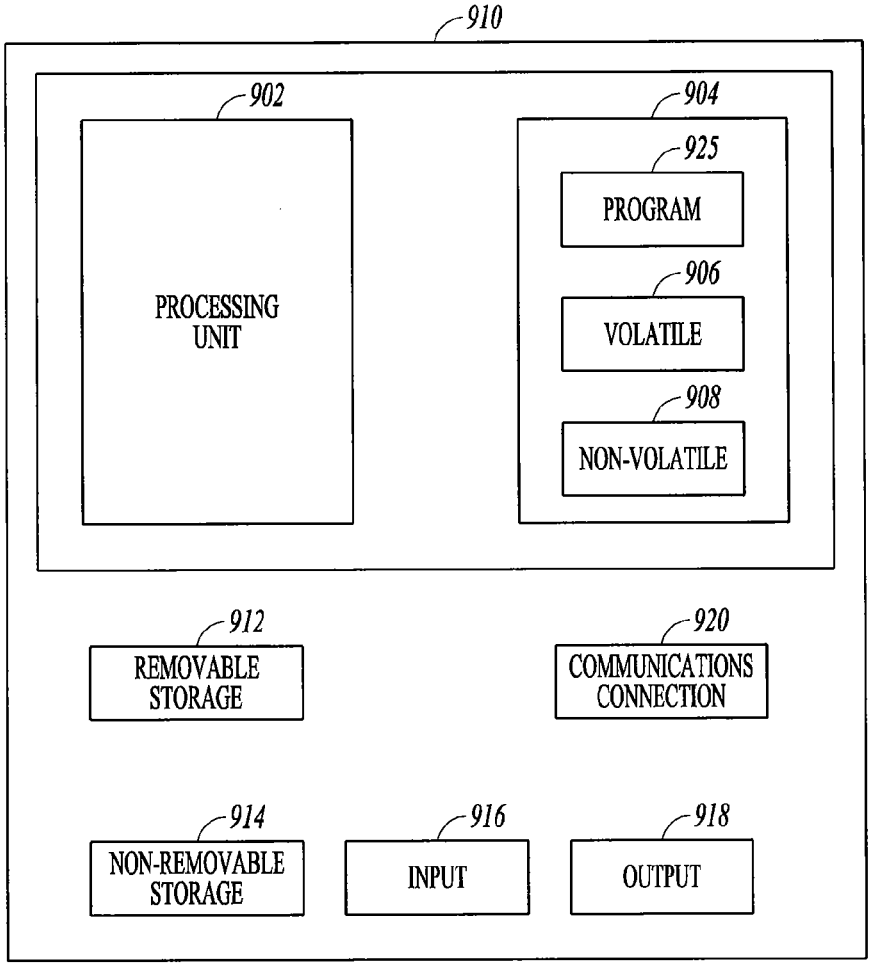
FIG. 9 is a block diagram of a computer system that executes programming for processing detected light according to an example embodiment.

By providing two visible, separately decoded detectors 610, 615 along the head [one of the left side and a second one on the left side], this aimpoint resolution can be expanded to determine the following:

Left body shot;
Right Body shot;
Center body shot;
Left side of head shot;
Right side of head shot; and
Center head shot A block diagram of a computer system that executes programming for processing detected light as described above is shown in FIG. 9. A general computing device in the form of a computer 910 or microcontroller, may include one or more of a processing unit 902, memory 904, removable storage 912, and non-removable storage 914. Memory 904 may include volatile memory 906 and non-volatile memory 908. Computer 910 may include—or have access to a computing environment that includes—a variety of computer-readable media, such as volatile memory 906 and non-volatile memory 908, removable storage 912 and non-removable storage 914. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices, or any other medium capable of storing computer-readable instructions. Computer 910 may include or have access to a computing environment that includes input 916, output 918, and a communication connection 920. The computer may operate in a networked environment using a communication connection to connect to one or more remote computers. The remote computer may include a personal computer (PC), server, router, network PC, a peer device or other common network node, or the like. The communication connection may include a Local Area Network (LAN), a Wide Area Network (WAN) or other networks.

Computer-readable instructions to execute methods and algorithms described above may be stored on a computer-readable medium such as illustrated at a program storage device 925 are executable by the processing unit 902 of the computer 910. A hard drive, CD-ROM, and RAM are some examples of articles including a computer-readable medium.

The Abstract is provided to comply with 37 C.F.R. §1.72(*b*) is submitted with the understanding that it will not be used to interpret or limit the scope or meaning of the claims.

The invention claimed is:

1. A device comprising:

a first light source to be aligned along a path of a projectile, the first light source having a narrow divergence to simulate the path of the projectile; and a second light source having a vertically wide divergence extending above the path of the projectile, wherein the first and second light sources are encoded, diverged, and aligned to facilitate distinguishing between head and body shots using only head sensors wherein the second light source includes an optical element to reduce light transmitted below the projectile path.

2. The device of claim 1 wherein the first and second light sources are encoded by time difference.

3. The device of claim 1 wherein the first light source has a vertical divergence of between approximately 3-4 miliradians.

4. The device of claim 3 wherein the first light source has a horizontal divergence of approximately 2 miliradians or less.

5. The device of claim 1 wherein the second light source has a vertical divergence of approximately 6 miliradians.

6. The device of claim 1 wherein the second light source is aligned on a same path as the first light source.

7. The system of claim 1 wherein the first and second light sources comprise lasers encoded with digital information.

8. The system of claim 7 wherein the first and second light sources are further encoded by time difference.

9. The system of claim 1 wherein the first light source has a vertical divergence of between approximately 3-4 miliradians and a horizontal divergence of approximately 2 miliradians or less, and wherein the second light source has a vertical divergence of approximately 6 miliradians.

10. A system comprising:

a headset having two horizontally spaced apart light sensors to be worn by a target;

a first light source to be aligned along a path of a projectile, the first light source having a narrow divergence to simulate the path of the projectile; and a second light source having a vertically wide divergence extending above the path of the projectile, wherein the first and second light sources are encoded, diverged, and aligned to facilitate distinguishing between head and body shots using only the headset sensors wherein the second light source includes an optical element to reduce light transmitted below the projectile path.

11. The system of claim 10 wherein the two horizontally spaced apart light sensors are positioned near sides of the headset, and wherein the headset further comprises a rear light sensor.

12. The system of claim 10 and further including a controller to receive signals from the light sensors and to distinguish between a head shot and a body shot.

13. The system of claim 12 wherein the controller further distinguishes between center of mass, left center of mass, right center of mass, left head, center head, and right head shots.

14. A method comprising:

projecting a first light source aligned along an expected path of a projectile, the first light source having a narrow divergence to simulate the expected path of the projectile; and projecting a second light source having a vertically wide divergence extending above the expected path of the projectile, wherein the first and second light sources are encoded and aligned to facilitate distinguishing between head and body shots using only head sensors wherein the second light source includes an optical element to reduce light transmitted below the projectile path.

15. The method of claim 14 and further comprising:

detecting light from the first and second light sources via two spaced apart head sensors;

receiving signals from the head sensors representative of the detected light; and processing the received signals to determine whether a head shot or a body shot is represented by the detected light.

16. The method of claim 15 and further comprising processing the received signals to distinguish between center of mass, left center of mass, right center of mass, left head, center head, and right head shots.

* * * * *